United States Patent [19]

Doran et al.

[11] Patent Number: 4,804,183

[45] Date of Patent: Feb. 14, 1989

[54] DOUBLE FACED SPORTS RACQUET

[75] Inventors: Brian A. Doran, Buellton, Calif.; Robert H. Redkey, 1630 Maple, Solvang, Calif. 93463

[73] Assignee: Robert H. Redkey, Solvang, Calif.

[21] Appl. No.: 172,090

[22] Filed: Mar. 23, 1988

Related U.S. Application Data

[63] Continuation of Ser. No. 24,612, Mar. 11, 1987.

[51] Int. Cl.[4] ..... A63B 51/06; A63B 49/08

[52] U.S. Cl. ..... 273/73 C; 273/73 J; 273/75; 273/73 L

[58] Field of Search ..... 273/73 C, 73 D, 73 E, 273/73 G, 73 H, 73 J, 73 L, 75, 81 R, 81.4, 81 B, 81 D, 26 A; 16/114 R

[56] References Cited

U.S. PATENT DOCUMENTS

| | | | |
|---|---|---|---|
| 1,558,507 | 10/1925 | Ryder | 273/73 E |
| 1,684,449 | 9/1928 | Kleinman | 273/73 E |
| 3,612,526 | 10/1971 | Brull | 273/73 H X |
| 4,153,249 | 5/1979 | Plagenhoef | 273/73 C |
| 4,282,642 | 8/1981 | Rodgers, Jr. | 273/73 J |
| 4,509,228 | 4/1985 | Landsburger | 16/114 R |

FOREIGN PATENT DOCUMENTS

| | | | |
|---|---|---|---|
| 198361 | 11/1976 | Argentina | 273/73 L |
| 1050581 | 3/1979 | Canada | 273/73 C |
| 2405941 | 8/1975 | Fed. Rep. of Germany | 273/73 D |
| 3521621 | 1/1986 | Fed. Rep. of Germany | 273/73 J |
| 189874 | 12/1922 | United Kingdom | 273/73 L |
| 1048123 | 11/1966 | United Kingdom | 273/81 R |

OTHER PUBLICATIONS

"Grip-It"; The Sporting Goods Dealer Magazine; p. 137, May 1978.

*Primary Examiner*—Richard C. Pinkham
*Assistant Examiner*—William E. Stoll
*Attorney, Agent, or Firm*—Price, Gess & Ubell

[57] ABSTRACT

A sports racquet having two string faces each with a different tension to provide variable playing characteristics. The racquet is further equipped with two different grip surfaces to assist the player in detecting which racquet face is in use and with a grip which is inflatable to vary the grip "feed". A cassette loadable racquet face insert is also provided to enable a player to readily change one of the string faces to any of a number of different tension settings.

4 Claims, 2 Drawing Sheets

DOUBLE FACED SPORTS RACQUET

This is a continuation of Application Ser. No. 024,612, filed Mar. 11, 1987.

BACKGROUND OF THE INVENTION

1. Field of the Invention

The subject invention relates to sports racquets and, more particularly, to a double faced racquet for providing different string tensions.

2. Description of Related Art

In the prior art, it is known that different string tensions and grip "feels" on tennis racquets affect playing performance. Generally speaking, the higher the tension, the greater the control and the lower the tension, the greater the power. Improper string tensioning can result in too much rebound off the center of the racquet, loss of control over off-center hits, excessive vibration or a very harsh or "dead" feel.

It is further possible to alter the pace of the game and prepare for different styles of play be varying the tension on the racquet. It has occurred to the inventors that it would be advantageous to provide a racquet which provides more than one available tension which can be selected during play by slight of hand. It has further occurred to the inventors that a variable pressure racquet grip would permit adaptation of the grip to various situations and styles of play. Provision of such a racquet must overcome several obstacles, including the need to maintain a lightweight design and provide a properly balanced design.

SUMMARY OF THE INVENTION

Accordingly, it is an object of the invention to provide an improved sports racquet.

It is another object of the invention to provide a sports racquet providing different string tensions.

It is yet another object of the invention to provide a sports racquet having two tensions which may be readily selected during play by slight of hand without mechanized adjustments.

It is still another object of the invention to provide a sports racquet with an adjustable grip "feel".

These and other objects and advantages are achieved according to the invention by a racquet having two sets of strings, one on each side of a racquet face, each set being adjusted to provide a different tension. Additional features include a grip which indicates to the player which racquet face he is using by associating a different feel with each side of the racquet. Another novel feature is the provision of an inflatable grip which may be permanently adjusted to vary the feel of the grip. Finally, a cassette loadable feature is disclosed wherein cassettes of various string tensions may be loaded into a racquet receptacle.

BRIEF DESCRIPTION OF THE DRAWINGS

The just summarized invention will now be described in detail in conjunction with the drawings of which.

DETAILED DESCRIPTION OF THE PREFERRED EMBODIMENT

Figure 1:
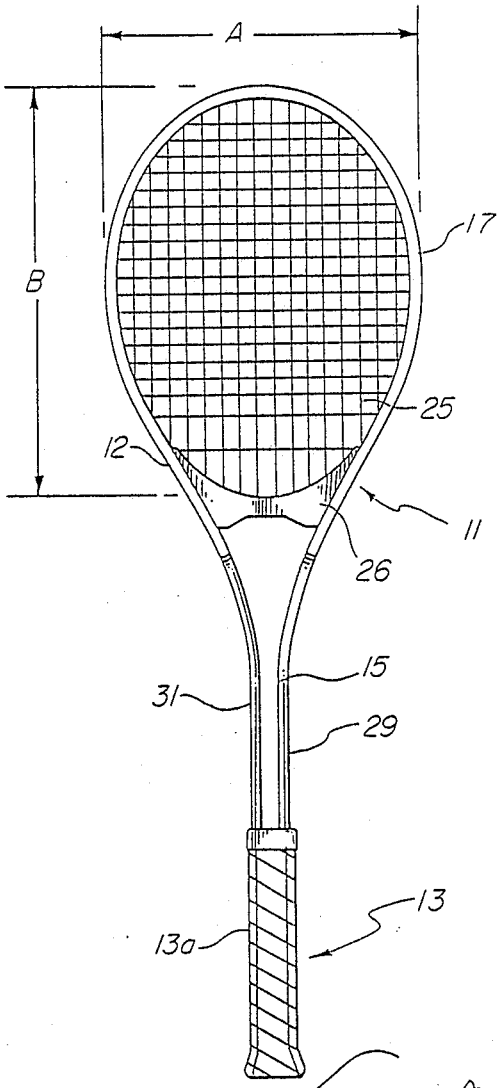
FIG. 1 is a perspective view of a racquet according to the preferred embodiment.

FIG. 1 illustrates a racquet 11 according to the preferred embodiment. While the embodiment will be described with reference to a tennis racquet, it will be understood that the invention is not limited thereto but is applicable to other racquet designs for other racquet sports such as racquetball, squash, etc. The racquet includes a frame 12 of aluminum, graphite, ceramic, fiberglass or other suitable material. The front contour of the frame 12 is like that of a typical tennis racquet. The frame 12 includes a neck 15 and a racquet face 17. The neck 15 is fixed in a handle grip 13.

Figure 2:
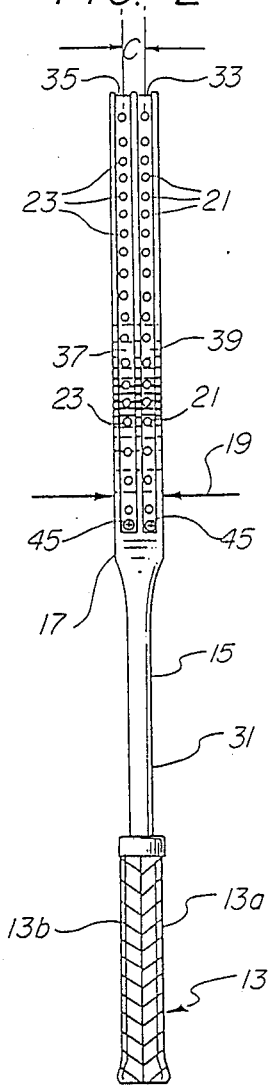
FIG. 2 is a side view of the racquet of the preferred embodiment.
Figure 6:
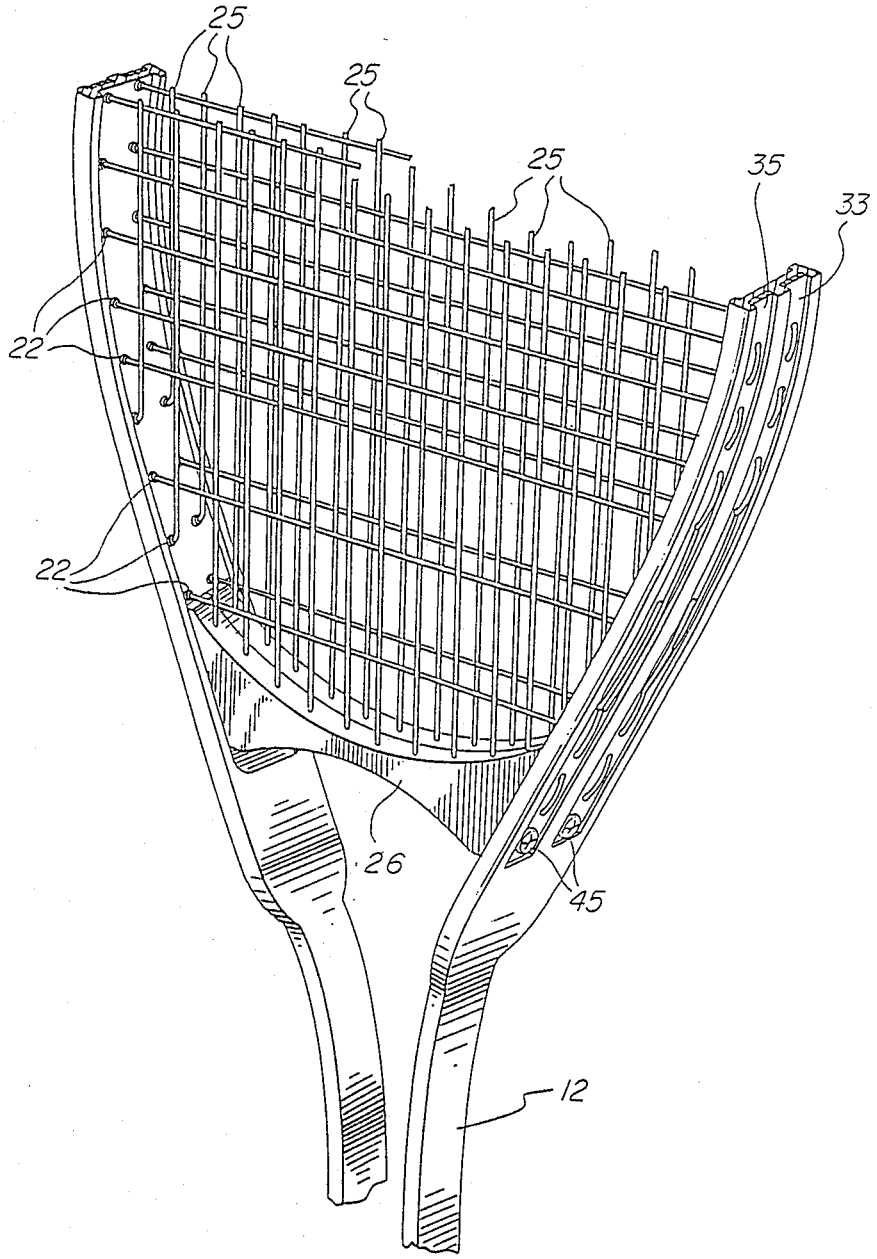
FIG. 6 is a sectional perspective of a racquet according to the preferred embodiment.

As shown in FIG. 2, the neck 15 widens at the face 17 to provide a wider side dimension 19. This wider side dimension 19 permits the creation of two recessed channels 33, 35 provided in the frame 12 around the periphery of the racquet face 17. Holes 21, 23 are drilled in each channel 33, 35, forming two lines of string holes about the periphery of the racquet face 17. As best seen in FIG. 6, two sets of strings are strung on the racquet 11, one set in each line of holes 23, 25. Each of the sets of strings 25 is wound at a different tension, as hereafter discussed in more detail.

The channels 33, 35 are lined with respective plastic inserts 37, 39. Each insert 37, 39 provides a plastic grommet 22 (FIG. 6) which protrudes through each string hole 21, 23 and protects the strings 25 from direct contact with the metal holes 21, 23, which might tend to damage the strings 25. The recess provided by the channel 33, 35 further protects the strings 25 from wear or damage.

A relatively hard plastic bridge member 26 is inserted into the gap between the two struts 29, 31 of the neck 15 to close the racquet face 17. The insert 26 also contains holes 21, 23 which receive the strings 25 as part of the two lines of string holes distributed around the periphery of the racquet face 17. Screws 45 are screwed through the plastic inserts 37, 39 and into the bridge member 26 on either side of the racquet face 17 to retain the bridge member 26 and plastic inserts 37, 39.

For a midsize tennis racquet, the preferred embodiment has a head dimension "A" of nine and three quarter inches and "B" of twelve and three quarter inches with a total racquet length of twenty seven inches. The number of horizontally running strings 25 is sixteen and the number of vertically running strings 25 is nineteen to give a total number of seventy strings, considering both sides of the racquet. The same number of strings are used in each set and the strings of each set are preferably uniformly spaced, i.e. respective strings run parallel to one another in both horizontal and vertical directions in order to meet the rules of the United States Tennis Association. The preferred width "C" between the two sets of strings ranges from ¼ inches to 2 inches. Finally, the preferred tension is 40 lbs. for one racquet face and 60 lbs. for the other, although it will be understood that various other tensions can be provided. Various other dimensions can also be provided as desired to yield an oversized or undersized racquet.

As further shown in FIG. 2, the racquet handle grip 13 includes two different cover materials **13*a*, 13*b*. These materials 13*a*, 13*b* indicate to a player which side of the racquet he is using. The two cover materials 13***a*, 13*b* may comprise, for example, leather and Gamma Grip.

Figure 3:
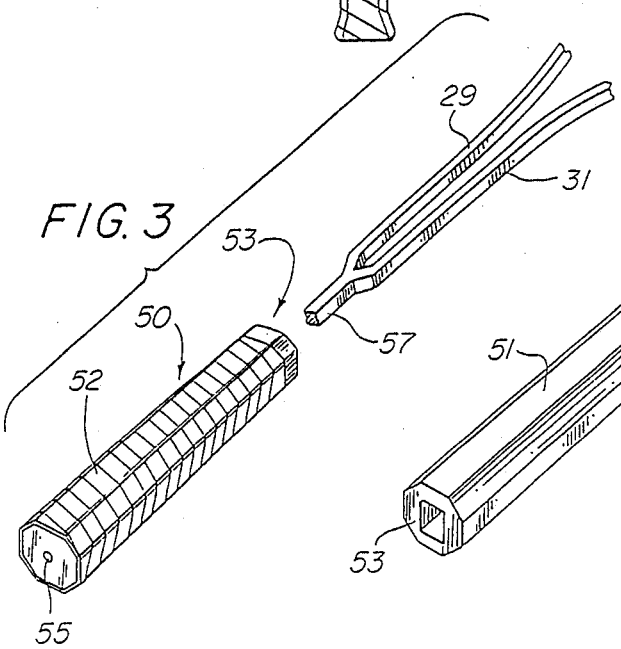
FIG. 3 is a perspective cut away illustrating an inflatable grip according to the preferred embodiment.
Figure 4:
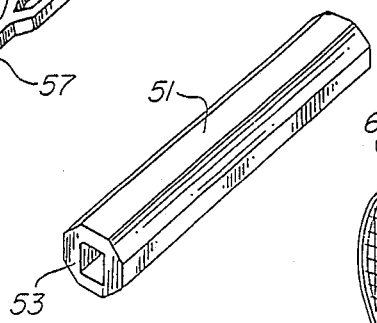
FIG. 4 is a perspective of the opposite end of the inflatable grip of FIG. 3.

FIGS. 3 and 4 illustrate a still further improved racquet handle 50 for use in the preferred embodiment. This handle 50 includes an inflatable hard rubber inner bladder 51, with an inner opening 53 of generally square or rectangular cross-section. The outer contour of the bladder 51 conforms to the shape of a typical racquet handle, e.g. hexagonal as shown. The bladder 51 is inflatable by insertion of a pump needle into a valve 55. The bladder 51 is further surrounded by an outer grip material 52, which may comprise two grip surfaces, such as 13*a*, 13*b*.

In operation, the bladder 51 functions like a football or basketball bladder. Inflation and deflation of the bladder 51 varies the feel of the grip 13.

As further shown in FIG. 3, the struts 29, 31 of the racquet neck 15 are formed into a unitary rod 57 which fits snugly into the opening 53 of the bladder 51 in the deflated state. The rod 57 is shown broken off in FIG. 3. It preferably extends to within about one inch of the end of the handle 50 in which the valve 55 is mounted. Inflation of the bladder 51 then serves to fix the bladder 51 to the rod 57 by press-fit. Variation of the degree of inflation beyond the press-fit pressure then varies the grip "feel". Use of this improved inflatable handle structure allows variation in the degree of the absorption of racquet shock, a major factor in tennis elbow. It also permits switching to different grips, e.g. of different color or feel.

Figure 5:
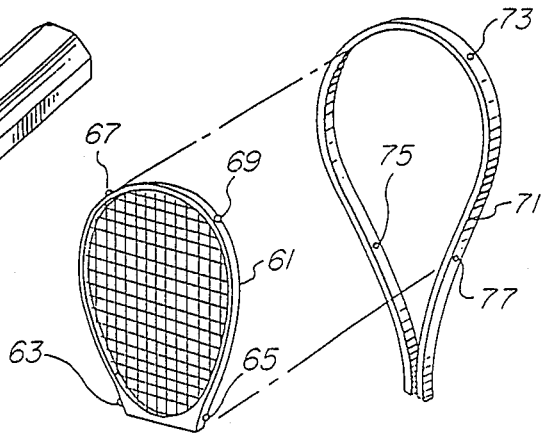
FIG. 5 is a perspective of a loadable cassette embodiment.

As an additional improvement, a face may be made removable, such that another string face with a different tension may be inserted, thus avoiding the necessity to restring the racquet to vary the tension provided. An embodiment achieving such a feature is illustrated in FIG. 5. According to FIG. 5, a "cassette" racquet face insert 61 is provided with a preset tension. This cassette 61 may be inserted and removed from a cooperating racquet frame 71. A number of cassettes 61 are preferably provided, each with a different tension, yielding selectable string tensions. Preferably, the cassette 61 is snap-loadable as by means of fixed retainer tabs 63, 65 and spring-loaded pins 67, 69, which fit into cooperating holes, e.g. 73, 75, 77 in the racquet frame 71. Alternatively, screws may be provided at, e.g. the tab and pin insertion points of FIG. 5 to facilitate removal and replacement of the cassettes 61.

A variety of snap-insertion techniques will of course be apparent to those skilled in the art. Additionally, one or both of the racquet faces of an embodiment such as that shown in FIG. 1 may be cassette loadable.

The invention provides numerous other advantages. Racquet tension may be easily varied as the player advances from beginner to intermediate to advanced player status. The advanced player can use the double sided feature to achieve tactical advantage by slight of hand. In other words, the racquet may be turned around during play to present the string face most suitable for each hit, a process which is assisted by the provision of two different grip materials such that a tactile indication of racquet position may be maintained. Older players or the physically handicapped can select high or low tension. From a teaching point of view, the racquet tension can be changed to a lower tension for instructional purposes.

From the foregoing, it will be appreciated that numerous modifications can be made in the disclosed preferred embodiment without departing from the scope and spirit of the invention. Therefore, it is to be understood that within the scope of the appended claims, the invention may be practiced other than as specifically disclosed herein.

What is claimed is:

1. A sports racquet for use by a user in hitting a ball or like object comprising:

a unitary racquet face having first and second sets of holes about its periphery;

a first set of strings laced through said first set of holes and interlaced across said racquet face and having a first tension setting;

a second set of strings laced through said second set of holes and interlaced across said racquet face and having a second tension setting;

a neck attached to said racquet face having first and second struts extending from said racquet face, said first and second struts being formed into a unitary end member;

a handle including an inflatable bladder means for adjusting the feel of said handle, for receiving said unitary end member and for attaching said handle to said end member when inflated such that said handle may be removed and replaced by inflation and deflation of said bladder means; and first and second cover materials on said handle, positioned such that said first cover material indicates to the user of said racquet that said first set of strings is in position to hit and such that said second cover material indicates that said second set of strings is in position to hit.

2. A sports racquet for use by a user in hitting a ball or like object comprising:

a racquet face member;

first means for interlacing a first set of strings across said racquet face at a first tension setting;

second means for interlacing a second set of strings across said racquet face at a second tension setting, at least one of said first and second means comprising a loadable cassette means for inserting and removing at least one of said first and second sets of strings into and out of said racquet face;

a neck attached to said racquet face member having first and second struts extending from said racquet face member, said first and second struts being formed into a unitary end member;

a handle including an inflatable bladder means for adjusting the feel of said handle, for receiving said unitary end member and for attaching said handle to said unitary end member when inflated such that said handle may be removed and replaced by inflation and deflation of said bladder means; and first and second cover materials on said handle, positioned such that said first cover material indicates to the user of said racquet that said first set of strings is in position to hit and such that said second cover material indicates that said second set of strings is in position to hit.

3. A sports racquet for use by a user in hitting a ball or like object comprising:

a handle grip;

a neck attached to said handle grip;

a unitary racquet face attached to said handle grip having first and second set of holes about its periphery;

a first set of strings laced through said first set of holes and interlaced across said racquet face and having a first tension setting;

a second set of strings laced through said second set of holes and interlaced across said racquet face and having a second tension setting;

a neck attached to said racquet face and extending therefrom to form a unitary end member;

a handle including an inflatable bladder means for adjusting the feel of said handle, for receiving said unitary end member and for attaching said handle to said end member when inflated such that said handle may be removed and replaced by inflation and deflation of said bladder means; and first and second cover materials on said handle, positioned such that said first cover material indicates to the user of said racquet that said first set of strings is in position to hit and such that said second cover material indicates that said second set of strings is in position to hit.

4. A sports racquet for use by a user in hitting a ball or like object comprising:

a racquet face member;

first means for interlacing a first set of strings across said racquet face at a first tension setting;

second means for interlacing a second set of strings across said racquet face at a second tension setting, at least one of said first and second means comprising a loadable cassette means for inserting and removing at least one of said first and second sets of strings into and out of said racquet face;

a neck attached to said racquet face member, extending therefrom and formed into a unitary end member;

a handle including an inflatable bladder means for adjusting the feel of said handle, for receiving said unitary end member and for attaching said handle to said unitary end member when inflated such that said handle may be removed and replaced by inflation and deflation of said bladder means; and first and second cover materials on said handle, positioned such that said first cover material indicates to the user of said racquet that said first set of strings is in position to hit and such that said second cover material indicates that said second set of strings is in position to hit.

* * * * *